US005335501A

United States Patent [19]

Taylor

[11] Patent Number: 5,335,501

[45] Date of Patent: Aug. 9, 1994

[54] FLOW SPREADING DIFFUSER

[75] Inventor: Jack R. Taylor, Cincinnati, Ohio

[73] Assignee: General Electric Company, Cincinnati, Ohio

[21] Appl. No.: 976,793

[22] Filed: Nov. 16, 1992

[51] Int. Cl.[5] ..... F02C 1/00

[52] U.S. Cl. ..... 60/751; 60/747

[58] Field of Search ..... 60/751, 746, 747

[56] References Cited

U.S. PATENT DOCUMENTS

| | | | |
|---|---|---|---|
| 2,556,161 | 6/1951 | Bailey | 60/751 |
| 2,833,115 | 5/1958 | Clarke et al. | 60/39.65 |
| 3,788,065 | 1/1974 | Markowski | 60/751 |
| 3,910,035 | 10/1975 | Juhasz et al. | 60/39.23 |
| 4,918,926 | 4/1990 | Nikkanen | 60/751 |
| 5,077,967 | 1/1992 | Widener et al. | 60/39.02 |
| 5,099,644 | 3/1992 | Sabla et al. | 60/267 |
| 5,134,855 | 8/1992 | Belcher et al. | 60/751 |

*Primary Examiner*—Richard A. Bertsch
*Assistant Examiner*—W. J. Wicker
*Attorney, Agent, or Firm*—Jerome C. Squillaro; David L. Narciso

[57] ABSTRACT

In accordance with the present invention, a diffuser for a gas turbine engine having a compressor providing compressed airflow thereto is disclosed having an outer wall and an inner wall, with a plurality of circumferential splitter vanes disposed therebetween to define a plurality of channels for diffusing airflow therethrough. The splitter vanes have an aft end and a leading edge, with the aft end being thicker and tapering in size to the leading edge. The splitter vanes also have a relatively thick bluff base region in order to better spread the airflow radially.

7 Claims, 3 Drawing Sheets

FLOW SPREADING DIFFUSER

BACKGROUND OF THE INVENTION

Field of the Invention

The present invention relates generally to a gas turbine engine diffuser for diffusing compressed air received from a compressor, and, more specifically, to a diffuser having a plurality of circumferential splitter vanes disposed therein to define a plurality of passages for diffusing airflow channeled therethrough.

Description of Related Art

A gas turbine engine compressor is utilized for providing compressed or pressurized airflow to a combustor where it is then mixed with fuel for undergoing combustion to power the engine. The compressed airflow is discharged from the compressor at a relatively high velocity and, therefore, a diffuser it typically utilized for decreasing the velocity of the compressed airflow while increasing the static pressure thereof (known as pressure recovery), which enables more efficient operation of the combustor and the engine. A conventional diffuser has an inlet and an outlet defined between diverging walls with an effective area ratio of the outlet area over the inlet area for obtaining diffusion. The diffuser also includes a length from the inlet to the outlet and the inlet has a specific height.

In order to reduce the length of the diffuser, it is conventionally known to provide a diffuser having multiple diffusing channels, for example, two diffuser channels separated by a circumferentially extending splitter, as exemplified by U.S. Pat. No. 5,077,967 to Widener, et al. In such a design, the compressed airflow from the compressor is divided by the splitter and portions thereof are channeled in parallel through the two channels for separately diffusing the airflow portions. Although each channel is smaller than the original single channel which would otherwise be required, they still have the same length to height ratios and equal area ratios for maximizing pressure recovery with acceptable flow separation margin. The two channels, which are relatively shorter than a corresponding single channel diffuser, can thus collectively provide the same amount of total pressure recovery from the airflow.

For conventional combustor systems with relatively low dome flows, the flow leaving the diffuser spreads uniformly to the combustor cowlings with high pressure recovery and good performance. However, for modern lean burning combustors with high dome flows and large dome heights, the flow from a conventional diffuser will not spread out enough to provide uniform flow to the combustor dome. As is well known, uniform flow through the dome is very important for minimizing pollutant emissions. Also, while a long complex cowling arrangement could be used to provide better uniformity, such cowlings are heavy and costly and would require large holes therein to provide access for fuel injectors.

Accordingly, a primary objective of the present invention is to provide a diffuser for diffusing compressed airflow in a combustor having high dome flows and large dome heights.

Another objective of the present invention is to provide a diffuser which eliminates the need for cowling around a combustor.

Yet another objective of the present invention is to provide a diffuser having a large area ratio which provides high pressure recovery within a short diffuser length.

These objectives and other features of the present invention will become more readily apparent upon reference to the following description when taken in conjunction with the following drawing.

SUMMARY OF THE INVENTION

In accordance with the present invention, a diffuser for a gas turbine engine having a compressor providing compressed airflow thereto is disclosed having an outer wall and an inner wall, with a plurality of circumferential splitter vanes disposed therebetween to define a plurality of channels for diffusing airflow therethrough. The splitter vanes have an aft end and a leading edge, with the aft end being thicker and tapering in size to the leading edge. The splitter vanes also have a relatively thick bluff base region in order to better spread the airflow radially.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
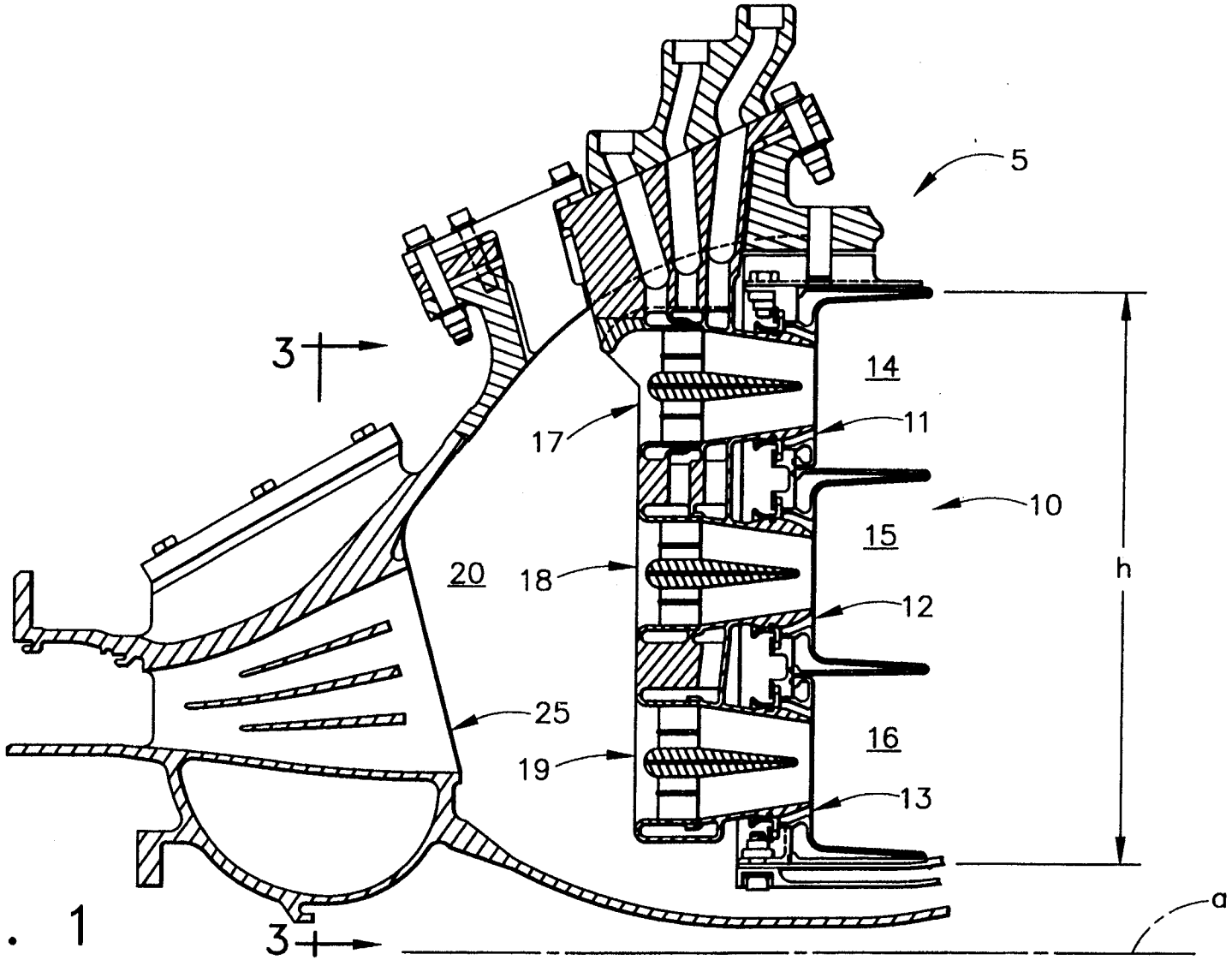
FIG. 1 is a cross-sectional view through a triple annular combustor utilizing the diffuser of the present invention.

Referring now to the drawings in detail, wherein identical numerals indicate the same elements throughout the figures, FIG. 1 depicts a triple annular combustor which comprises a hollow body defining a combustion chamber therein. At the upstream end of combustor 5 a domed end 10 having an outer dome 11 a middle dome 12, and an inner dome 13 is provided. It will be noted that dome 10 of combustor 5 has an overall height h through which air is supplied for mixing with fuel into outer combustion zone 14, middle combustion zone 15 and inner combustion zone 16. It will be noted that triple annular combustor 5 corresponds to that described in U.S. Ser. No. 07/976,752 entitled "Triple Annular Combustor", which is also owned by the Assignee of the present invention and hereby incorporated by reference. As noted therein, combustor 5 further includes outer fuel/air mixing means 17, middle fuel/air mixing means 18 and inner fuel/air mixing means 19. Upstream thereof is a diffuser dump region 20 into which compressed air flow is supplied by a compressor of the gas turbine engine (not shown).

Channeling the compressed airflow into diffuser dump region 20 is diffuser 25. Because triple annular combustor 5 has a relatively large dome height h (approximately 10 inches) and requires high dome flows to minimize pollutant emissions, diffuser 25 functions to diffuse the compressed airflow uniformly across dome 10.

Figure 2:
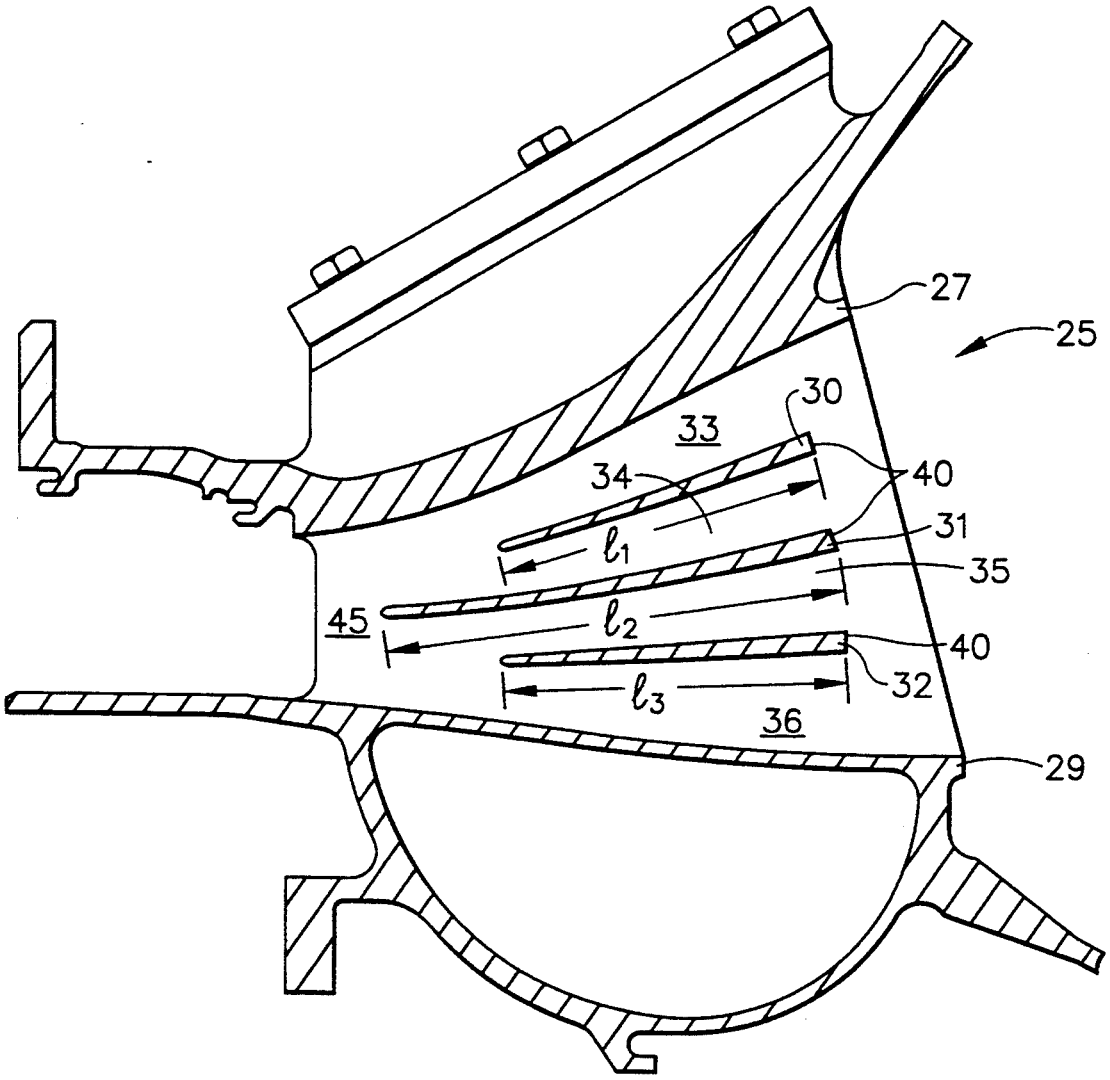
FIG. 2 is an enlarged cross-sectional of the diffuser depicted in FIG. 1.
Figure 3:
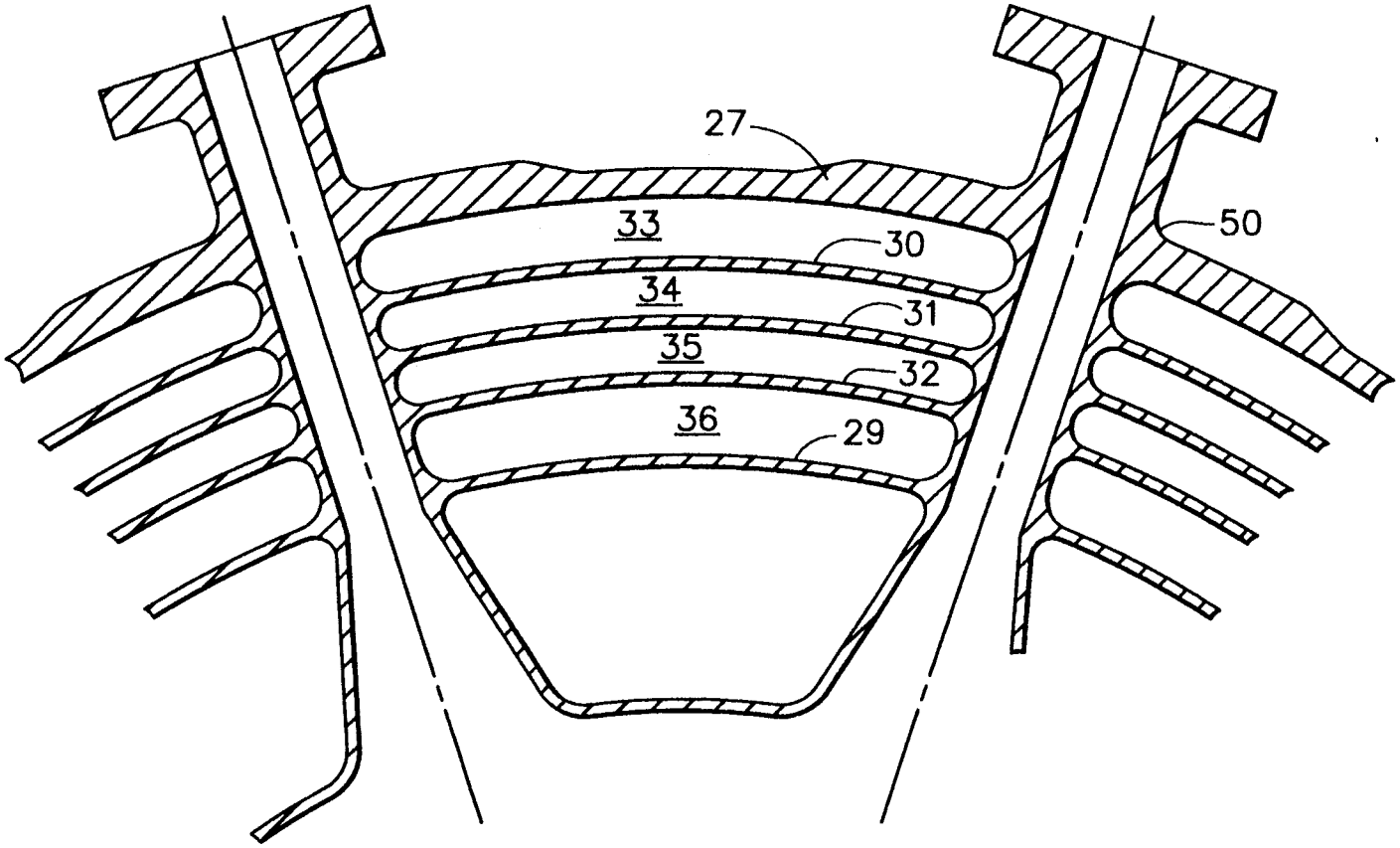
FIG. 3 is a forward view of the diffuser depicted in FIGS. 1 and 2 taken along lines 3—3.

As illustrated in FIGS. 2 and 3, diffuser 25 in accordance with the present invention is an annular diffuser disposed coaxially about a center line axis a and includes an annular, radially outer, first wall 27 and a radially inner, annular second wall 29 spaced radially inwardly from the first wall 27. Provided between outer wall 27 and inner wall 29 is a plurality of circumferential splitter vanes 30, 31 and 32. Accordingly, a first passage or channel 33 is provided between outer splitter vane 30 and outer wall 27, a second passage or channel 34 is provided between middle splitter vane 31 and outer splitter vane 30, a third passage or channel 35 is provided between inner splitter vane 32 and middle splitter vane 31, and a fourth passage or channel 36 is provided between inner diffuser wall 29 and inner splitter vane 32. With this design, a large diffuser area ratio can be used to provide a high pressure recovery within a short diffuser length.

Figure 4:
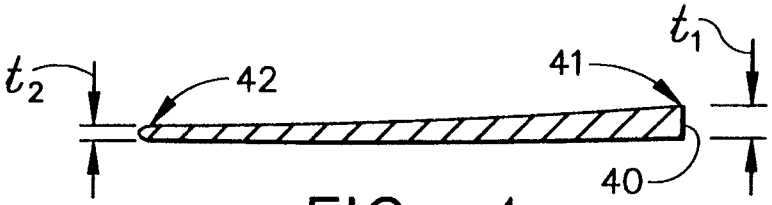
FIG. 4 is a partial cross-sectional view of a splitter vane in FIGS. 1-3.

As best seen in FIGS. 2 and 4, circumferential splitter vanes 30, 31 and 32 have a thick, bluff base region 40 in order that the compressed airflow can be spread out radially to produce uniform flow at combustor dome 10. In addition, splitter vanes 30, 31 and 32 preferably are thicker at their trailing edge 41, from which they taper more or less uniformly to a relatively thin leading edge 42. Thin leading edges 42 are needed in order to reduce the flow blockage effect in a diffuser inlet region 45 in this regard, the ratio of the thickness $t_1$ of the trailing edge 41 to the thickness $t_2$ of leading edge 42 preferably being in range of 2 to 10.

It will further be noted that the respective lengths $l_1$, $l_2$, $l_3$ of outer splitter vane 30, middle splitter vane 31, and inner splitter vane 32, respectively, may be different. In FIG. 2, middle splitter vane 31 preferably extends upstream of outer splitter vane 30 and inner splitter vane 32 in order to enhance the ability of the compressed airflow to flow through channels 33, 34, 35 and 36.

It will also be seen that diffuser 25 includes a plurality of struts 50 positioned circumferentially therearound which are casted with, and used to support, splitter vanes 30, 31 and 32 as a one-piece structure.

Having shown and described embodiment of the present invention, further adaptations of the combustor can be accomplished by appropriate modifications by one of ordinary skill in the art without departing from the scope of the invention.

I claim:

1. A diffuser for a gas turbine engine having a compressor providing compressed airflow, said gas turbine engine having a longitudinal axis therethrough, comprising:

(a) an outer wall;

(b) an inner wall spaced radially inward from said outer wall;

(c) at least three circumferential splitter vanes disposed between said outer and inner walls, each of said splitter vanes being spaced radially from each other and said inner and outer walls to define a plurality of passages between said outer and inner walls for diffusing airflow channeled therethrough, wherein a middle splitter vane of said at least three splitter vanes extends further upstream than said other splitter vanes in order to enhance the ability of the compressed airflow to flow through said passages.

2. The diffuser of claim 1, each of said splitter vanes having relatively thick bluff base regions compared to a leading edge of each of said splitter vanes, wherein radial spreading of the airflow is enhanced.

3. The diffuser of claim 1, wherein said splitter vanes are of differing lengths.

4. The diffuser of claim 1, further including a plurality of radial struts positioned circumferentially therearound to support said splitter vanes.

5. The diffuser of claim 1, each of said splitter vanes having a leading edge and an aft end, wherein said aft end is thicker than said leading edge.

6. The diffuser of claim 5, wherein each of said splitter vanes are tapered approximately uniformly from said aft end to said leading edge.

7. The diffuser of claim 5, wherein the ratio of said aft end thickness to said leading edge thickness is approximately 3.

* * * * *